United States Patent [19]

Cox et al.

[11] 4,171,542

[45] Oct. 23, 1979

[54] DISPOSABLE SURGICAL GOWN WITH A BIB FORMING A HAND SUPPORT

[75] Inventors: Lloyd A. Cox, Memphis; Doyle R. Johnson, Arlington; Donald F. Maskey; William A. Mueller, both of Memphis, all of Tenn.

[73] Assignee: Buckeye Cellulose Corporation, Memphis, Tenn.

[21] Appl. No.: 912,333

[22] Filed: Jun. 5, 1978

[51] Int. Cl.[2] ..... A41D 13/00

[52] U.S. Cl. ..... 2/51; 2/114; 2/247; 2/DIG. 7

[58] Field of Search ..... 2/51, 52, 114, DIG. 7, 2/91, 85, 74, 69, 247; 128/132 D, 132 R

[56] References Cited

U.S. PATENT DOCUMENTS

| | | | |
|---|---|---|---|
| 2,846,686 | 8/1958 | Tames | 2/DIG. 7 |
| 2,964,755 | 12/1960 | Priebe | 2/51 |
| 3,359,569 | 12/1967 | Rotanz et al. | 2/114 |
| 3,803,640 | 4/1974 | Ericson | 2/114 |
| 3,868,728 | 3/1975 | Krzewinski | 2/DIG. 7 |

*Primary Examiner*—H. Hampton Hunter

*Attorney, Agent, or Firm*—Frost & Jacobs

[57] ABSTRACT

A single-use, nonwoven surgical gown having a bib at the chest area configured to provide a sterile hand support pocket in the aseptic zone and an additional barrier layer in the critical chest area to guard against microbial transmission. The bib may also be configured to provide a belt tunnel within which a wraparound belt may be attached and stored and which will allow for vertical adjustment of the belt while providing the surgical gown with a clear and unencumbered front. The bib is attached to the inside of the gown front with access to the hand support pocket and bib tunnel through appropriately located slits in the gown front.

14 Claims, 8 Drawing Figures

DISPOSABLE SURGICAL GOWN WITH A BIB FORMING A HAND SUPPORT

BACKGROUND OF THE INVENTION

1. Field of the Invention

The invention relates to a disposable surgical gown and more particularly to such a gown provided with a bib configured to provide an additional barrier layer and a hand support pocket and which may additionally serve to form a belt tunnel for a wraparound belt.

2. Description of the Prior Art

It is not unusual for there to be long periods of inactivity between the start and conclusion of certain involved operating procedures. For example, the surgeon may need results on the phases of the operation already completed, such as X-rays or pathology reports, before he can continue with the rest of the operation. Sometimes, there are parts of an operating procedure which do not require hands, such as during perfusion operations where medicated blood is circulated through parts of the patient's body for long periods of time. In various teaching situations, a surgeon frequently stops and talks, allowing the assistant to continue.

During such periods of manual inactivity, operating room procedures require that at all times the gloved and sterile surgeon maintain his hands in the restricted aseptic zone outlined by his waist, neck and shoulders. This is also true, of course, of the other members of the surgical team.

Heretofore prior art workers have devised various muff-type hand supports for reusable woven fabric surgical gowns. Frequently surgeons refuse to use disposable surgical gowns in favor of reusable gowns provided with hand support means, despite the fact that such reusable surgical gowns have certain deficiencies. For example, the reusable gowns are generally not liquid repellent when used, either because they are not treated for liquid repellency, or because repeated laundering and sterilization has removed any initial liquid repellency treatment. Reusable surgical gowns with hand support means are generally expensive to manufacture and therefor must be premium priced.

The present invention teaches various embodiments of bib-like structures providing, among other things, a sterile hand support pocket for a disposable surgical gown. The bib structures of the present invention do not materially add to the cost of manufacture of the disposable surgical gown and the hand support pocket formed thereby supports the surgeon's hands more centrally of the restricted aseptic zone.

Another problem with the use of surgical gowns is that of strike-through of liquids encountered during the surgical procedures (for example, blood, serums, treating fluids such as water and saline solutions, and the like). Such strike-through establishes a path for the transmission of bacteria to and from the wearer of the surgical gown. As indicated above, prior art reusable woven fabric surgical gowns were frequently not treated for liquid repellency or, even when so treated would not retain such liquid repellency by virtue of frequent laundering and sterilization.

Prior art workers have provided reusable surgical gowns with reinforcing front panels as, for example, taught in U.S. Pat. No. 2,846,686 in the name of Daniel Tames and issued on Aug. 12, 1958. In U.S. Pat. No. 3,011,172 in the name of Daniel Tames, issued Dec. 5, 1961, a reusable surgical gown is taught having a flexible panel of lightweight, moisture-proof and electrically conductive material secured over the major part of the inner surface of the front panel of the surgical gown. The moisture-proof and electrically conductive panel is taught as being made of a very thin sheet of synthetic rubber impregnated with carbon or other material of equivalent properties. U.S. Pat. No. 3,349,285 in the name of Nathan L. Belkin, issued Oct. 24, 1967, teaches a reusable gown, the upper front panel and the lower sleeve panels of which are made of closely woven cotton yarn treated with a water repellent chemical agent. In U.S. Pat. No. 3,609,767, in the name of Carl R. Grosz, issued Oct. 5, 1971, a reusable gown is taught having an outer apron-like member overlying the body portion of the surgical gown. U.S. Pat. No. 3,803,640, in the name of Richard E. Ericson, issued Apr. 16, 1974, teaches a surgeon's gown having a water resistant cummerbund.

Most of the prior art single-use surgical gowns have been made from fabrics treated for repellency. This has reduced strike-through, at least for a limited time. Prior art workers have devised single-use gowns intended for critical procedures, and premium priced, having a film lining in specific areas, for instance at the chest area where there may be a danger from pressure generated strike-through. Normally, polyethylene is used and is either applied as a separate laminate to the nonwoven fabric (thick enough to resist abrasion but stiff and inflexible) or cast onto the nonwoven fabric (where it penetrates between the fibers rendering the fabric stiff).

U.S. Pat. No. 2,668,294 in the name of Phyllis B. Gilpin, issued Feb. 9, 1954, teaches a disposable hospital gown of paper or nonwoven fabric, the front portion or all of which is treated with a suitable plastic (either manufactured into the material or applied after manufacture) for water repellency. U.S. Pat. No. 3,359,569 in the names of Robert J. Rotanz and Joseph F. Hanlon, issued Dec. 26, 1967, teaches a disposable surgical gown made of fluid repellent material such as a laminated scrim reinforced nonwoven material having a fluid repellent bib at the front of the gown and affixed thereto only at the shoulders. U.S. Pat. No. 3,868,728 in the name of Henrietta K. Krzewinski, issued Mar. 4, 1975, teaches a disposable surgical gown with a front panel or operative field having an absorbent outer surface and a liquid impervious inner surface. The front panel may be made of a nonwoven, extrusion coated with polyethylene, polypropylene or polyvinyl chloride. Alternatively, the front panel may constitute an absorbent polyurethane foam laminated to a fluid impervious material such as polyethylene; an absorbent tissue bonded to a sheet of polyvinyl chloride; or an absorbent nonwoven fabric bonded to a liquid impervious material such as polyvinyl chloride, polyethylene or the like. The bonding of the absorbent and liquid impervious layers may be an overall bond, a spot bond or a peripheral bond.

In accordance with the teachings of the present invention wherein a bib is affixed to the inside surface of the surgical gown front, the bib provides an additional layer of fabric in the critical chest area to guard against microbial transmission. The bib may be made of the same liquid repellent, nonwoven material as the surgical gown itself. Since porous, repellent, nonwoven fabrics normally can transmit liquids under pressure (for example, liquids clinging to the gloves of the surgeon can be transmitted through porous, repellent, nonwoven fabric when the glove is pressed against the fabric), the bib may be made of a fluid (both gas and liquid) impervious film or nonwoven-film laminate to be completely resistant to fluids. The bib may be made, for example, of the same nonwoven fabric as the remainder of the surgical gown and may be coated on one of its sides with a polymeric film-forming coating (such as acrylic latex of the like) which will provide a barrier against contamination via the route of fluid strike through. The gown remains comfortable to the wearer in spite of the lining of latex composition since the film lining is limited to the bib area and the rest of the gown remains breathable.

Reusable and disposable surgical gowns provided with a belt tunnel of one sort or another are shown in the previously mentioned U.S. Pat. Nos. 2,668,294; 2,846,686; and 3,011,172. U.S. Pat. No. 3,059,240 in the name of Armigene R. Johnson, issued Oct. 23, 1962, teaches a standard garment with a strap-attached belt permitting vertical belt adjustment.

In the surgical gown of the present invention the bib can be extended to provide a belt tunnel for a wrap-around-type belt. This not only improves protection against strike-through where the surgeon presses against the operating table, but also provides a clear, unencumbered front for the surgical gown, forcing the surgeon to tie the belt at the side rather than at the front where the tie loops could interfere with the operation. The belt tunnel provides a facility for storing the belt in folded condition; enbles the provision of means for vertical adjustment of the belt so that the surgical gown may be made in a limited number of sizes; and provides a better location for grasping the wraparound belt by the wearer or an attendant.

SUMMARY OF THE INVENTION

A single-use, nonwoven surgical gown is provided having a bib-like panel located on the inside surface of the front portion of the gown at the critical chest area thereof. The periphery of the bib is adhered to the inside surface of the surgical gown front. The gown front has a pair of spaced, substantially vertical slits located within the adhered periphery of the bib. The bib is additionally adhered to the surgical gown front along a substantially horizontal line spaced upwardly from the lower edge of the bib and just beneath the pair of slits so that the bib provides a hand support located centrally of the aseptic zone of the gown.

A second, shorter, substantially vertical, spaced pair of slits is located within the peripheral edge of the bib between the intermediate line of adherence of the bib to the surgical gown front and the lowermost peripheral line of adherence. In this fashion, the bib also forms a belt tunnel for storage of a wraparound belt prior to the wearing of the gown by the user. The wraparound belt may be adhered either to the inside surface of the front portion of the surgical gown or to that portion of the bib forming the belt tunnel. Preferably, the belt is attached to a strap which, in turn, is affixed to the surgical gown front and the bib at the intermediate line of adherence therebetween. This latter arrangement permits vertical adjustment of the belt within the belt tunnel so that the user may locate the belt at the most comfortable level and so that the surgical gown may be produced in a minimum number of sizes.

The bib itself may be made of a fluid impervious film or a nonwoven-film laminate to provide the critical chest area with a barrier against microbial transmission by fluid transport. The bib may be made, for example, of the same nonwoven material as the surgical gown, having a polymeric film-forming coating such as acrylic latex or the like cast on either that side facing the wearer or that side adjacent the inside surface of the surgical gown front. Similarly the bib could comprise two layers of the non woven material with a film barrier therebetween. The latex film will act as a barrier for microbial entitites.

It is within the scope of the invention to use the bib to form the hand support only, without the belt tunnel. In this instance the bottom edge of the bib may be adhered to the gown front along a horizontal line located just beneath the hand-receiving pairs of slits.

In both embodiments of the surgical gown of the present invention (with or without a belt tunnel), the bib may be provided with a downwardly depending extension adhered to the gown front to provide further protection against strike-through of the surgical gown at the position where the wearer would press against the operating table or the like.

DESCRIPTION OF THE PREFERRED EMBODIMENTS

Figure 1:
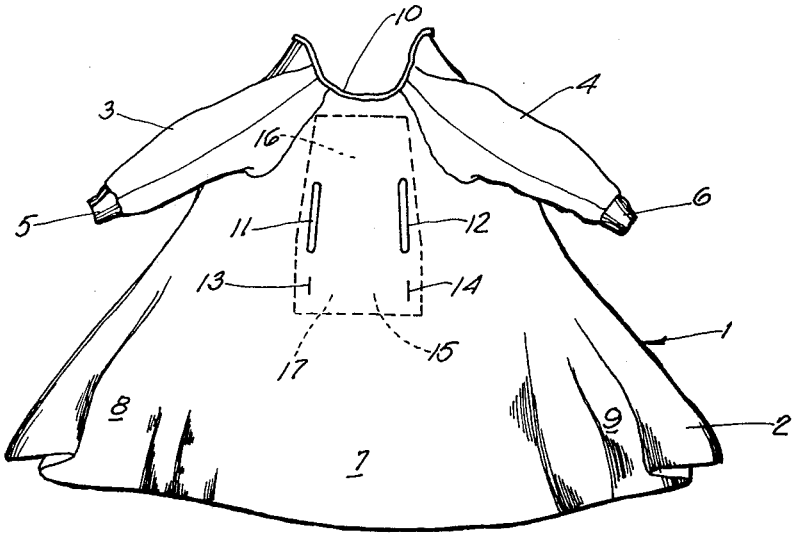
FIG. 1 is an elevational view of a disposable surgical gown of the type having a bib mounted on the inside surface of the surgical gown front and forming a hand support and a belt tunnel.
Figure 2:
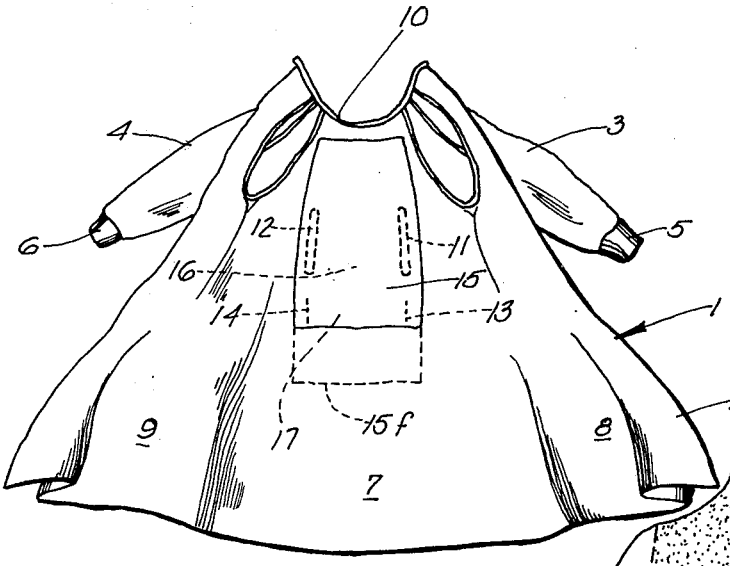
FIG. 2 is a rear elevational view of the disposable surgical gown of FIG. 1 illustrating the inside surface of the gown front and the bib mounted thereon.
Figure 3:
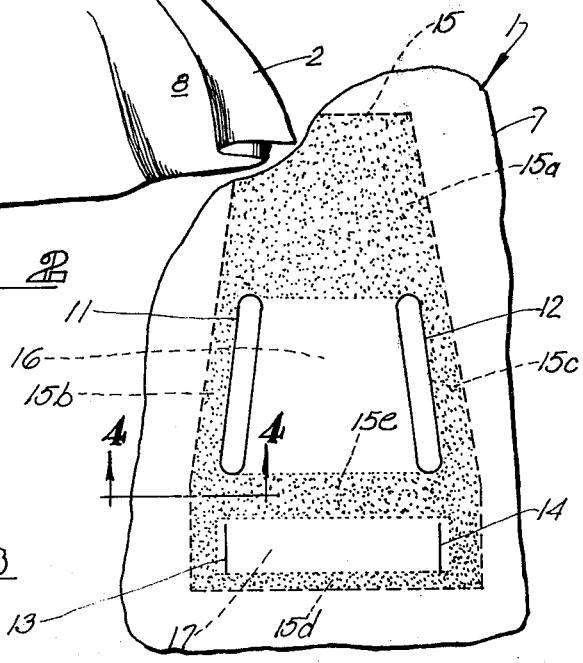
FIG. 3 is a fragmentary enlarged view of the front of the surgical gown of FIGS. 1 and 2 illustrating the bib, a first pair of slits for the hand support and a second pair of slits for the bib tunnel, the zones of adherence of the bib to the inside surface of the surgical gown front being diagramatically indicated by stipling.

A first embodiment of the present invention is illustrated in FIGS. 1 through 3 wherein like parts have been given like index numerals. In FIG. 1, a surgical gown is generally indicated at 1 and comprises a body covering portion 2 provided with sleeves 3 and 4. The sleeves, in turn, are provided with conventional cuffs 5 and 6, respectively or cuffs of the type taught in co-pending application Ser. No. 759,631 filed Jan. 17, 1977, in the names of Linda H. Smith and Robert C. Johnson and entitled A LIQUID IMPERVIOUS CUFF FOR A DISPOSABLE SURGICAL GOWN AND METHOD OF ATTACHMENT OF THE CUFF THERETO.

The surgical gown is of the back-closing type so that the body portion 2 comprises a front portion 7 and lateral portions 8 and 9 which close and overlap at the back of the user. The neck of the gown may be provided with a lining tape 10 for strength and comfort.

While not necessarily so limited, since the surgical gown of the present invention is intended to be a single-use, disposable gown, it is preferably made of nonwoven fabric. Excellent results are achieved, for example, when the gown is made of tissue laminates. The various seams formed in the gown may be sewn and the cuffs and neck-lining tape may be attached by sewing. Preferably, to avoid sewing holes in the gown, the various seams and the attachment of the cuffs and neck-lining tape to the gown are accomplished through the use of appropriate adhesive means or by heat-sealing, if at least some of the parts are made of heat-sealable material.

The front portion 7 of the gown, bounded by the wearer's neck, shoulders and waist line, constitutes which is known as the aseptic zone within which the user must maintain his hands during periods of inactivity. To this end, the front portion 7 of the gown is provided with a pair of slits 11 and 12 of such size that the wearer's hands may be readily inserted through them. As is most clearly shown in FIG. 3, the slits 11 and 12 are preferably elongated, narrow cut-outs having rounded ends so as to resist tearing when the user's hands are at rest in the hand support. While the slits 11 and 12 are essentially vertical, they may slope slightly upwardly and inwardly to facilitate the passage of the wearer's hands therethrough.

Beneath the slits 11 and 12 there is located a second pair of slits 13 and 14 which, as will be evident hereinafter, give access to a belt tunnel for a wraparound belt. The slits 13 and 14 are shorter than slits 11 and 12 and may constitute single-line cuts rather than cut-outs as in the case of slits 11 and 12.

A bib-like panel 15 is affixed to the inside surface of the surgical gown front 7 at the location of the slit pairs 11–12 and 13–14. The panel 15, as is most clearly shown in FIG. 3, is so sized that its sides extend slightly beyond the slits 11 and 12 and the slits 13 and 14, its bottom edge extends just below slits 13 and 14 and its top edge is located about 3 or 4 inches below neck lining tape 10. As is indicated diagrammatically by stipling, the upper portion of the bib 15 is adhered to the inside surface of the surgical gown front 7 above slits 11 and 12 and along a substantially horizontal zone of attachment **15*a*. The sides of the bib are adhered adjacent slits 11 and 12 and near slits 13 and 14 along substantially vertical zones of attachment 15*b* and 15*c*. The bottom of the bib is attached to the surgical gown beneath the lower ends of slits 13 and 14 along a substantially horizontal zone of attachment 15*d*. An intermediate, substantially horizontal zone of attachment 15*e* between the bib and the surgical gown is located above the slits 13 and 14 and just below slits 11 and 12**.

Joinder of the bib 15 to the inside surface of the surgical gown front 7 may be accomplished in any appropriate manner compatible with the materials used. Adherence at **15*a* through 15*e*** may, for example, be accomplished through the use of an appropriate adhesive.

That portion of bib 15 bounded by **15*a*, 15*b*, 15*c* and 15*e* constitutes a hand support packet 16 for the wearer, access to which is gained through slits 11 and 12. That portion of the bib bounded by 15*b*, 15*c*, 15*d* and 15*e* constitutes a belt tunnel 17, access to which is gained through slits 13 and 14. It will be noted that the bib is attached to the inside surface of the surgical gown front 7 completely about the hand support packet 16 and completely about the belt tunnel 17**.

The zones of attachment **15*a* through 15*e* should be of such width as to provide a sufficiently strong bond between the bib 15 and the inside surface of the front portion 7 of the surgical gown. The zone of attachment 15*e* should be of greater width than the zones of attachment 15*b* through 15*d* since it will bear the weight of the user's hands at rest when the hands are located in the hand support 16 during periods of inactivity. In an exemplary embodiment the gown 1 and the bib 15 were made of a nonwoven material such as the tissue laminate described in copending application Ser. No. 741,604, filed Nov. 15, 1976, in the names of Larry LaFitte and James Camden and entitled QUIET, STRONG, CLOTH-LIKE TISSUE LAMINATE. The gown 1 and bib 15 were adhesively bonded together and adequate strength was achieved when the attachment zones 15*b* through 15*d* were from about ½ inch to 1 inch wide and attachment zone 15*e* was approximately twice the width of attachment zones 15*b* through 15*d***.

In an exemplary embodiment the bib 15 was made of the same nonwoven material as the surgical gown itself (i.e., the tissue laminate described above) and had cast thereon a film-forming coating of an acrylic latex composition. An exemplary latex composition is manufactured by B. F. Goodrich Chemical Company, of Cleveland, Ohio under the trademark Hycar 2679. The latex film forms a barrier for microbial entities.

Figure 4:
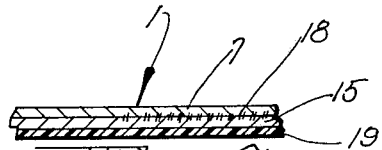
FIG. 4 is a fragmentary cross sectional view taken along section line 4—4 of FIG. 3.

FIG. 4 illustrates the front portion 7 of the surgical gown 1 with the bib 15 adhesively bonded thereto as at 18. That surface of bib 15 adjacent the wearer of the surgical gown is provided with a latex film 19 of the type described above. It will be understood by one skilled in the art that the latex film 19 may be applied to the opposite surface of bib 15, within the scope of the present invention. Similarly, the bib could comprise two nonwoven layers with a film therebetween. It will further be understood that in FIG. 4 the thickness of the gown front 7, bib 15 and film 19 have been exaggerated for purposes of clarity.

The belt of the surgical gown of the present invention may be made of any appropriate material. For example, it may constitute an elongated strip of the same nonwoven fabric as the gown, itself. The belt may be a single thickness strip of the nonwoven material or it may be folded longitudinally upon itself and double stitched longitudinally. The wraparound belt may be adhesively bonded within belt tunnel 17 directly to the inside surface of the front portion 7 of the surgical gown 1 or to the bib 15.

Figure 5:
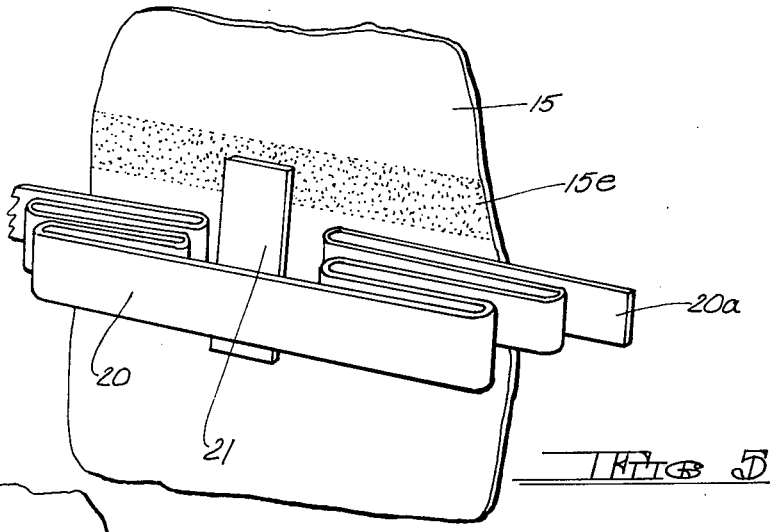
FIG. 5 is a fragmentary perspective view illustrating a wraparound belt in folded condition and attached to the bib by strap means.

FIG. 5 is a fragmentary perspective view illustrating one manner in which a wraparound belt may be attached within the belt tunnel and folded therein for storage. In FIG. 5 a fragmentary portion of bib 15 is shown. A belt 20, constituting a single thickness strip of the same nonwoven fabric as the surgical gown is also illustrated. The belt 20 is heat bonded or adhesively attached to a strap 21. The strap 21 may also constitute a strip of the same nonwoven fabric as that from which the surgical gown is made. It will be understood by one skilled in the art that the bib 15, belt 20 and strap 21 are greatly exaggerated in thickness for purpose of clarity.

The free end of strap 21 may be attached directly to bib 15 or to the inside surface of the front portion 7 of the surgical gown. Preferably, the free end strap 21 is adhered to both, being located in the horizontal attachment zone 15e (see also FIG. 3).

Figure 6:
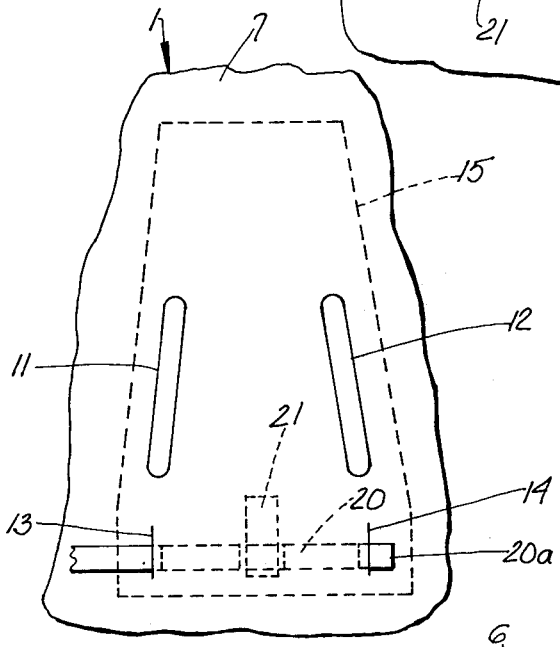
FIG. 6 is a fragmentary enlarged view of the front of the surgical gown of FIG. 1, similar to FIG. 3, and illustrating the bib and the wraparound belt located in the belt tunnel.

As is most clearly shown in FIG. 5, the belt (to either side of strap 21) is folded back and forth upon itself with one of its free ends (such as end 20a) projecting slightly beyond the folded portions of the belt. The other of the belt ends preferably extends beyond the belt tunnel to the side of the gown. The last mentioned end, not shown, is preferably provided with a detachable sterilized paper envelope or the like, lightly tacked or otherwise affixed to the gown, by which it may be grasped by an assistant, detached from the gown, passed about the wearer and handed to the wearer who removes the end from the envelope held by the assistant and ties the belt, the other end having been removed by the wearer from belt tunnel 17. Such a protective envelope for the belt end (not shown) is well known in the art. FIG. 6 is a fragmentary enlarged view of the front portion of the surgical gown, similar to FIG. 3. FIG. 6 illustrates the belt 20 in its stored position within belt tunnel 17 with the end 20a of the belt projecting slightly beyond belt tunnel slit 14. One or both of the belt ends may be covered with a detachable sterilized paper envelope, if desired.

It will be evident from the figures that the belt tunnel will assure that the front portion 7 of the surgical gown will be clear and unencumbered. The belt tunnel will also preclude tying of the belt at the front of the gown where the belt might interfere with the operating procedures. When the belt is attached to the bib 15 and the inside surface of the front portion of the gown 1 by strap 21 and the belt tunnel slits 13 and 14 are of a greater length than the width of the belt, the belt may be adjusted vertically to determine the most comfortable position for the wearer. This also permits the gown to be made in only a limited number of sizes.

Figure 7:
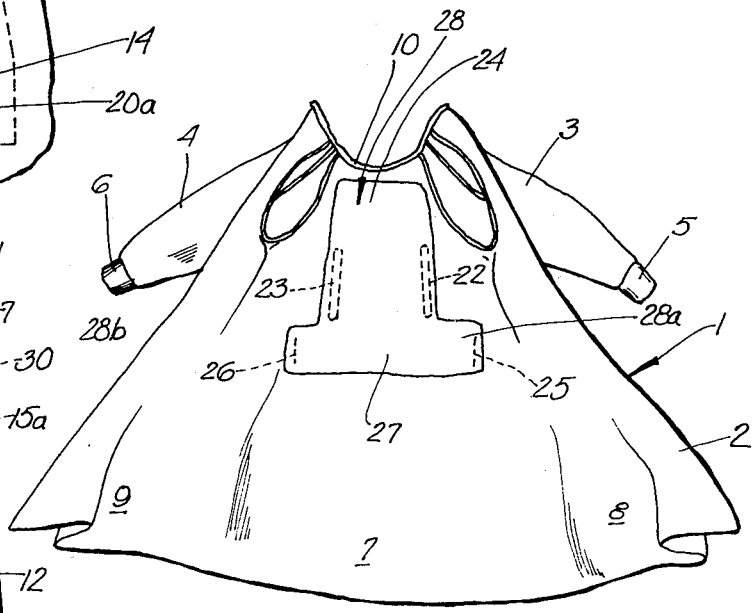
FIG. 7 is a rear elevational view of the surgical gown, similar to FIG. 2 and illustrating a bib of modified configuration.

A number of modifications may be made in the embodiment described with respect to FIGS. 1 through 6 without departing from the spirit of the invention. For example, the length, width and position of hand slots 11 and 12 and belt tunnel slots 13 and 14 may be varied so long as the hand support pocket 16 will maintain the hands centrally of the aseptic zone. An exemplary modification is illustrated in FIG. 7 wherein the surgical gown itself may be identical to that of FIGS. 1 and 2 and like parts have been given like index numerals. The front portion 7 of gown 1 is again provided with slits 22 and 23 which are equivalent to slits 11 and 12 of FIG. 2 and are intended to serve the same purpose i.e. access to a hand support pocket 24. The front portion of the gown is also provided with a pair of slits 25 and 26 equivalent to slits 13 and 14 of FIG. 2 and constituting access to a belt tunnel 27. The embodiment of FIG. 7 differs from that of FIG. 2 in that the bib (generally indicated at 28) has lateral extensions 28a and 28b. The bib may otherwise be identical to that described above and is affixed to the inside surface of the front portion 7 of the gown in the same manner. The lateral extensions 28a and 28b of the bib result in a greater distance between slits 24 and 25 (i.e., a longer belt tunnel 28). This, in turn, will place the exposed ends of the stored belt more nearly at the wearer's sides without changing the position of hand slits 22 and 23. It is within the scope of the invention to provide extensions 28a and 28b of sufficient length that they terminate at the sides of the gown or beyond. Where a belting procedure of the type described with respect to FIGS. 5 and 6 is used, it would be within the scope of the invention to provide bib 28 with only one extension 28a or 28b extending to one side of the gown for that belt end to be grasped and brought about the back of the gown by an assistant.

Figure 8:
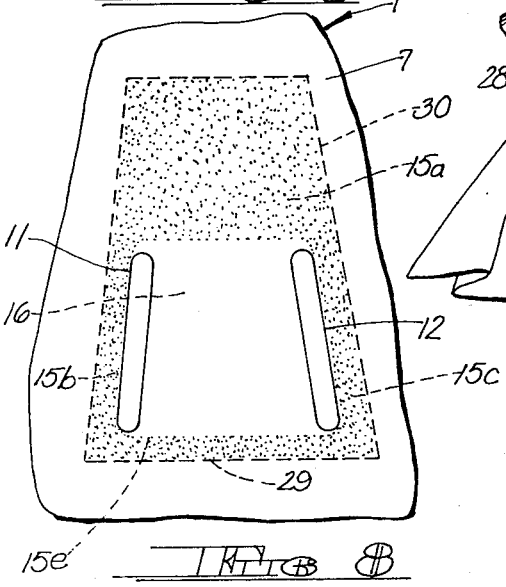
FIG. 8 is a fragmentary enlarged view, similar to FIG. 3 and illustrating another embodiment of the bib of the present invention wherein the bib forms a hand support without a belt tunnel.

In all of the embodiments thus far described the bib may terminate at the zone of attachment 15e so as to provide only a hand support, some other belting arrangement being applied to the surgical gown. This is illustrated in FIG. 8 which is similar to FIG. 3 and in which like parts have been given like index numerals. The embodiment of FIG. 8 differs from that of FIG. 3 only in that the bottom edge 29 of bib 30 terminates just below the zone of attachment 15c and a belt tunnel has been eliminated.

With or without a belt tunnel, the bib may be extended in length for additional protection to the wearer against microbial transmission and strike-through. For purposes of an exemplary illustration such an extension is shown in broken lines at 15f in FIG. 2.

Modifications may be made in the invention without departing from the spirit of it.

We claim:

1. In a surgical gown of the type having sleeves, a front portion having a chest area covering the chest of the user and side portions which close and overlap at the back of the user, the improvement comprising a bib affixed about its periphery to the inside surface of said surgical gown at said chest area thereof with a portion of said bib inwardly of said periphery remaining unsecured to said gown, said chest area of said gown having a pair of spaced, substantially vertical slits formed therein within the confines of said peripheral portions of said bib, said slits communicating with said unsecured portion of said bib and being of such length as to permit passage of the user's hands therethrough whereby said bib provides a sterile hand support pocket maintaining the user's hands in the aseptic zone bounded by the user's neck, shoulders and waist line.

2. The structure claimed in claim 1 wherein said bib is so configured as to have a substantially horizontal peripheral portion affixed to said gown chest area just below said hand receiving slits.

3. The structure claimed in claim 1 wherein said surgical gown is a single-use gown of nonwoven material.

4. The structure claimed in claim 1 wherein said bib is so configured as to have a lower substantially horizontal peripheral portion affixed to the inside surface of said gown chest area and being spaced below said pair of hand-receiving slits, said bib being additionally attached to said inside surface of said gown chest area along a substantially horizontal line just below said hand-receiving slits and above said lower peripheral portion, said portion of said bib between said lower peripheral portion and said additional line of attachment constituting a belt tunnel for said gown, said gown chest area having a second pair of substantially vertical slots formed therein at the ends of said belt tunnel to permit the passage of a belt therethrough.

5. The structure claimed in claim 1 wherein said bib has a lower portion extending below the waist of the user said bib being additionally affixed to said inside surface of said gown chest area by a pair of substantially horizontal upper and lower lines of attachment in parallel spaced relationship, said upper line of attachment being located just below said hand-receiving slits, said pair of upper and lower lines of attachment forming a belt tunnel for said gown, said gown chest area having a second pair of substantially vertical slits formed therein at the ends of said belt tunnel to permit the passage of a belt therethrough.

6. The structure claimed in claim 3 wherein said bib is made of the same non-woven material as said gown.

7. The structure claimed in claim 3 wherein said bib comprises a fluid impervious film.

8. The structure claimed in claim 3 wherein said bib comprises a nonwoven-fluid impervious film laminate.

9. The structure claimed in claim 4 wherein said bib has an inverted T-shaped peripheral configuration so that said belt tunnel is of a greater length than the width of said hand support pocket.

10. The structure claimed in claim 4 including a belt in folded condition located within said belt tunnel, a portion of said belt being affixed to one of said bib and said inside surface of said gown chest area within said tunnel.

11. The structure claimed in claim 4 including a belt in folded condition located within said tunnel, said belt being of lesser width than the distance between said lower peripheral portion of said bib and said additional line of attachment forming said belt tunnel, said belt having a laterally extending strap affixed thereto, said strap having a free end attached to at least one of said bib and said inside surface of said gown chest area, whereby said belt is adjustable vertically.

12. The structure claimed in claim 4 wherein said bib is made of the same nonwoven material as said gown.

13. The structure claimed in claim 4 wherein said bib comprises a fluid impervious film.

14. The structure claimed in claim 4 wherein said bib comprises a nonwoven-fluid impervious film laminate.

* * * * *

UNITED STATES PATENT AND TRADEMARK OFFICE

CERTIFICATE OF CORRECTION

PATENT NO. : 4,171,542

DATED : October 23, 1979

INVENTOR(S) : Lloyd A. Cox et al.

It is certified that error appears in the above-identified patent and that said Letters Patent are hereby corrected as shown below:

Column 3, line 6, "of" should read -- or --.

Column 4, line 8, "entitites" should read -- entities --.

Column 4, line 13, "pairs" should read -- pair --.

Column 5, line 20, "which", first occurrence, should read -- what --.

Signed and Sealed this

*Nineteenth* Day of *February 1980*

[SEAL]

*Attest:*

SIDNEY A. DIAMOND

*Attesting Officer*

*Commissioner of Patents and Trademark*